US006671890B2

(12) United States Patent
Nishioka

(10) Patent No.: US 6,671,890 B2
(45) Date of Patent: Jan. 6, 2004

(54) AUTOMATIC WATER FEED METHOD IN LAVATORY USING ARTIFICIAL RETINA SENSOR AND AUTOMATIC WATER FEED MECHANISM IN LAVATORY USING ARTIFICIAL RETINA SENSOR

(75) Inventor: Akira Nishioka, Osaka (JP)

(73) Assignee: San-Ei Faucet Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/022,157

(22) Filed: Dec. 14, 2001

(65) Prior Publication Data

US 2002/0073484 A1 Jun. 20, 2002

(30) Foreign Application Priority Data

Dec. 15, 2000 (JP) ..... 2000-382594
Dec. 25, 2000 (JP) ..... 2000-393147
Jun. 20, 2001 (JP) ..... 2001-185991

(51) Int. Cl.[7] ..... E03D 13/00
(52) U.S. Cl. ..... 4/304; 4/302; 4/623
(58) Field of Search ..... 4/302–305, 623, 4/DIG. 3; 358/163, 213; 340/573.1

(56) References Cited

U.S. PATENT DOCUMENTS 4,400,734 A * 8/1983 Davy ..... 348/616
4,679,077 A 7/1987 Yuasa et al.
4,767,922 A 8/1988 Stauffer
4,941,219 A * 7/1990 Van Marcke ..... 4/623
5,025,516 A * 6/1991 Wilson ..... 4/623
5,133,095 A 7/1992 Shiba et al.
5,202,666 A * 4/1993 Knippscheer ..... 340/573.1
5,570,869 A * 11/1996 Diaz et al. ..... 4/623
5,819,336 A 10/1998 Gilliam et al.
5,915,417 A 6/1999 Diaz et al.
5,980,123 A 11/1999 Heifler
5,984,262 A 11/1999 Parsons et al.
6,082,407 A 7/2000 Paterson et al.
6,426,701 B1 * 7/2002 Levy et al. ..... 340/573.1
6,459,493 B1 * 10/2002 Sugiura et al. ..... 356/630

FOREIGN PATENT DOCUMENTS

JP 2000-113272 A * 4/2000
JP 2000-259307 A * 9/2000

* cited by examiner

*Primary Examiner*—Tuan N. Nguyen

(57) ABSTRACT

An automatic water feed system and method for providing control of water to lavatory appliances upon sensing a user. The system having a control valve for controlling the flow of water, an artificial retina sensor for acquiring two dimensional images of a user adjacent the lavatory appliance, a memory for storing a predetermined characteristic of the acquired two dimensional images, and a comparison unit for comparing a subsequently acquired two dimensional image characteristic with the previously stored two dimensional image characteristic, whereby the control valve is activated when the differences between the previously and subsequently acquired two dimensional image characteristics satisfy a predetermined condition.

8 Claims, 19 Drawing Sheets

(A)

(B)

(C)

AUTOMATIC WATER FEED METHOD IN LAVATORY USING ARTIFICIAL RETINA SENSOR AND AUTOMATIC WATER FEED MECHANISM IN LAVATORY USING ARTIFICIAL RETINA SENSOR

BACKGROUND OF THE INVENTION

1. Field of the Invention

The present invention relates to a novel automatic water feed method in lavatory using an artificial retina sensor and a novel automatic water feed mechanism in lavatory using the artificial retina sensor, being configured to feed water automatically in a lavatory such as flush urinal and hand washer by means of an artificial retina sensor.

2. Description of the Prior Art

FIG. 29 shows a conventional hand washer 602 for feeding water automatically by using a light reflection system. In FIG. 29, a sensor unit 603 comprises light emitting means (not shown) for emitting light $L_1$ such as infrared ray or near infrared ray toward the user U, and light receiving means (not shown) for receiving reflected light $L_2$ coming from the user U. When the reflected light $L_2$ is received, water is supplied from a discharge pipe 602*a* installed on a mounting plane 601 of a basin 600 of the hand washer 602.

However, since the light emitting means is set so that the light $L_1$ may be directed toward a bowl 604, if the bowl 604 is made of stainless steel or other metal of high reflectivity and the bottom is shallow, similar light other than the reflected light $L_2$ may enter the light receiving means, which may cause a wrong detection.

SUMMARY OF THE INVENTION

The invention is devised in the light of the above problem, and it is hence an object thereof to detect the user of the lavatory securely.

To achieve the object, the automatic water feed method in lavatory using artificial retina sensor of the invention (a first aspect of the invention) is configured to control the water feed operation of a lavatory such as flush urinal and hand washer by visually recognizing the user of the lavatory by means of an artificial retina sensor.

That is, in the first aspect of the invention, the user of the lavatory can be detected securely by the artificial retina sensor.

A second aspect of the invention presents an automatic water feed method in lavatory using artificial retina sensor, being configured to control the water feed operation of a lavatory such as flush urinal and hand washer by visually recognizing the user of the lavatory by means of an artificial retina sensor, and further to limit the viewing field region of the artificial retina sensor only in the region of water discharge from the lavatory.

That is, in the second aspect of the invention, by setting the viewing field region of the artificial retina sensor so that the input image captured by the artificial retina sensor may not include the region out of reach of water discharged from the lavatory, useless information can be omitted, and therefore the recognition object image (acquired image) obtained by the artificial retina sensor is sharper, the motion of the hands positioned on the water discharge line from the lavatory can be judged accurately, so that malfunction can be prevented securely.

A third aspect of the invention presents an automatic water feed mechanism in lavatory using the artificial retina sensor comprising a lavatory such as flush urinal or hand washer, an artificial retina sensor for visually recognizing the user of the lavatory, and a control unit for controlling water feed operation of the lavatory on the basis of the output from the artificial retina sensor.

A fourth aspect of the invention presents an automatic water feed mechanism in lavatory using the artificial retina sensor comprising a lavatory such as flush urinal or hand washer, an artificial retina sensor for visually recognizing the user of the lavatory, and a control unit for controlling water feed operation of the lavatory on the basis of the output from the artificial retina sensor, in which the viewing field region of the artificial retina sensor is limited to include only the region of water discharge from the lavatory.

In the fourth aspect of the invention, too, by omitting useless information, the recognition object image (acquired image) is sharper, and the motion of the hands positioned on the water discharge line can be judged accurately. As a result, malfunction can be prevented.

A fifth aspect of the invention presents an automatic water feed method in lavatory using the artificial retina sensor comprising a lavatory such as flush urinal or hand washer, an artificial retina sensor for visually recognizing the user of the lavatory, and a control unit for controlling water feed operation of the lavatory on the basis of the output from the artificial retina sensor, in which a plurality of artificial retina sensors are provided in order to recognize the user visually together with a perspective sense.

A sixth aspect of the invention presents an automatic water feed mechanism in lavatory using the artificial retina sensor comprising a lavatory such as flush urinal or hand washer, an artificial retina sensor for visually recognizing the user of the lavatory, and a control unit for controlling water feed operation of the lavatory on the basis of the output from the artificial retina sensor, in which a plurality of artificial retina sensors are provided in order to recognize the user visually together with a perspective sense.

DETAILED DESCRIPTION OF THE PREFERRED EMBODIMENTS

Preferred embodiments of the invention are described below while referring to the accompanying drawings. It must be noted, however, that the invention is not limited by the illustrated embodiments alone.

FIG. 1 to FIG. 14 show embodiment 1 of the invention.

Figure 1:
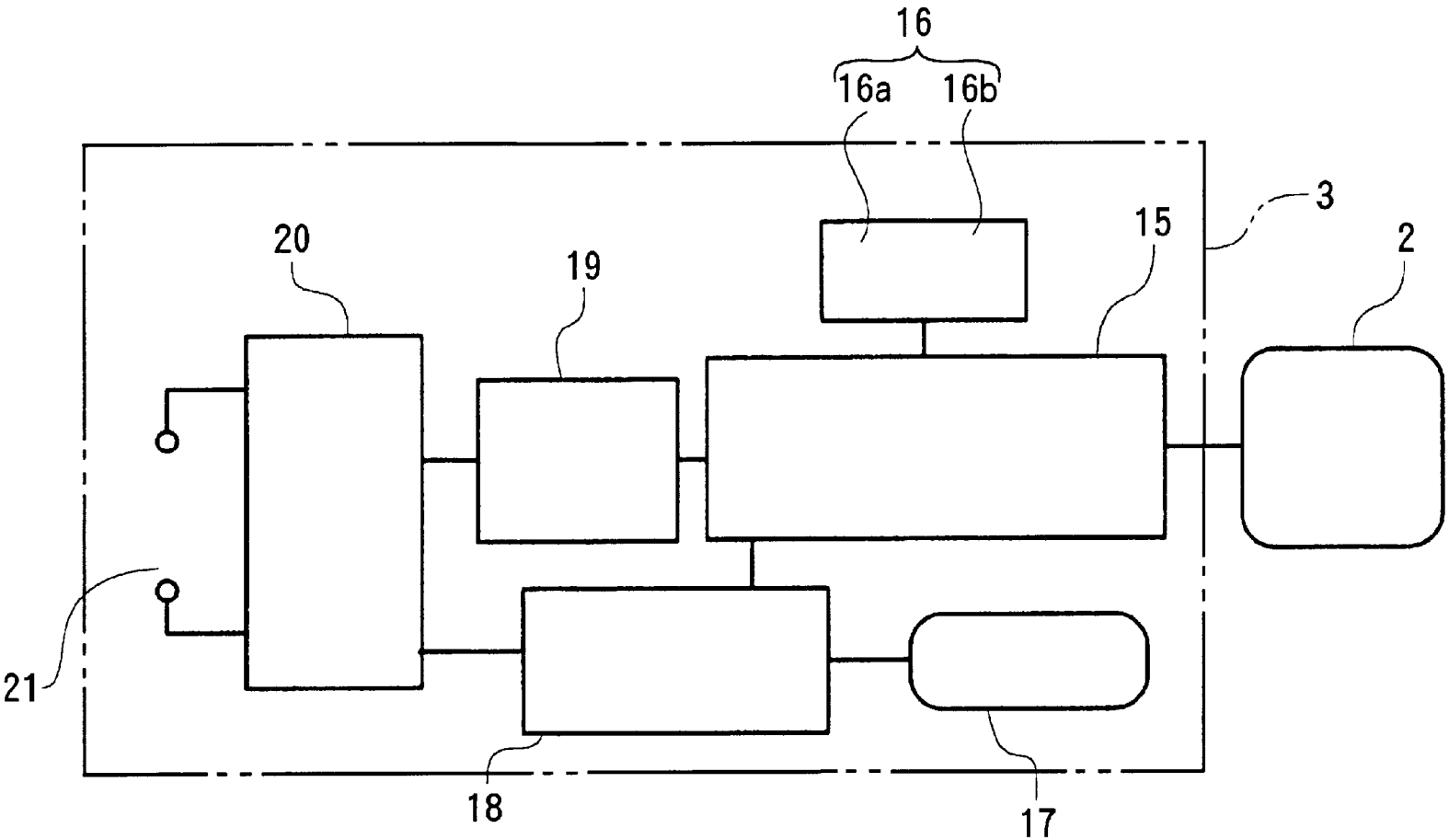
FIG. 1 is a general structural explanatory diagram showing embodiment 1 of the invention.
Figure 3:
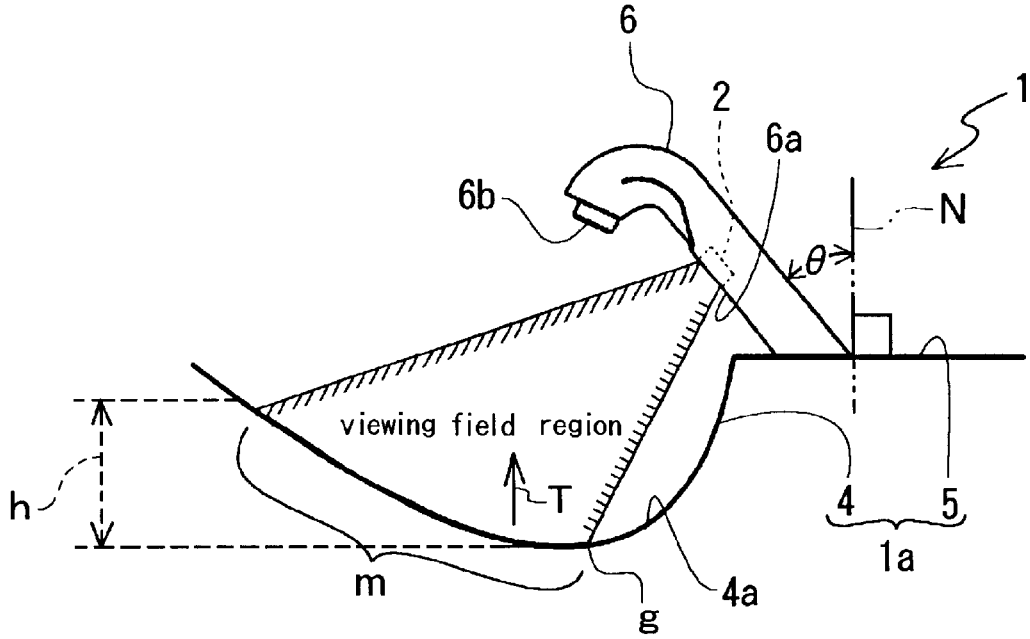
FIG. 3 is a structural explanatory diagram showing a range of viewing field region of artificial retina sensor in the height direction in the embodiment.

In FIG. 1 and FIG. 3, an automatic water feed mechanism mainly consists of a hand washer 1, an artificial retina sensor 2, and a control unit 3 for controlling the water feed operation of the hand washer 1 on the basis of the output of the artificial retina sensor 2.

Further, the hand washer 1 is composed of a basin 1*a* composed of a bowl 4 and a horizontal mounting plane 5, and a faucet main body having a discharge pipe 6 installed on the horizontal mounting plane 5. The bowl 4 is white in color. The discharge pipe 6 is inclined by a specified angle θ (θ being an acute angle) from a vertical plane N perpendicular to the horizontal plane of the horizontal mounting plane 5 to the bowl 4 side so as to be directed to the bowl 4. Reference numeral 6*b* is a discharge port.

Figure 2:
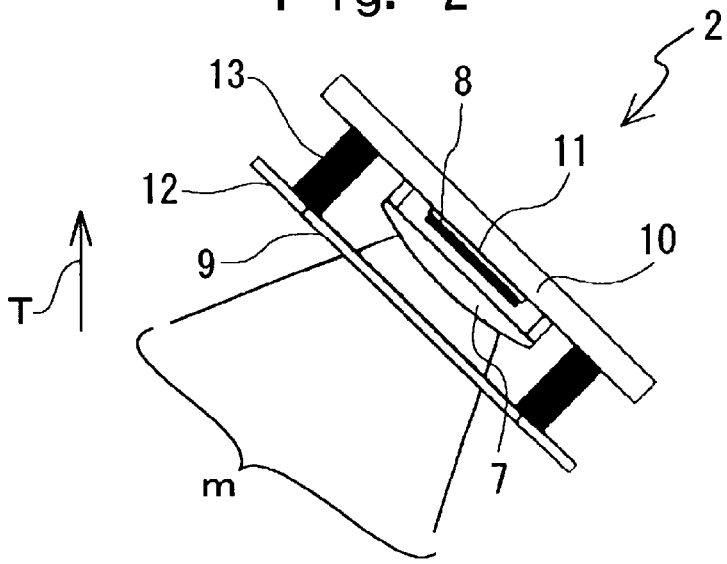
FIG. 2 is a structural explanatory diagram of artificial retina sensor in the embodiment.
Figure 4:
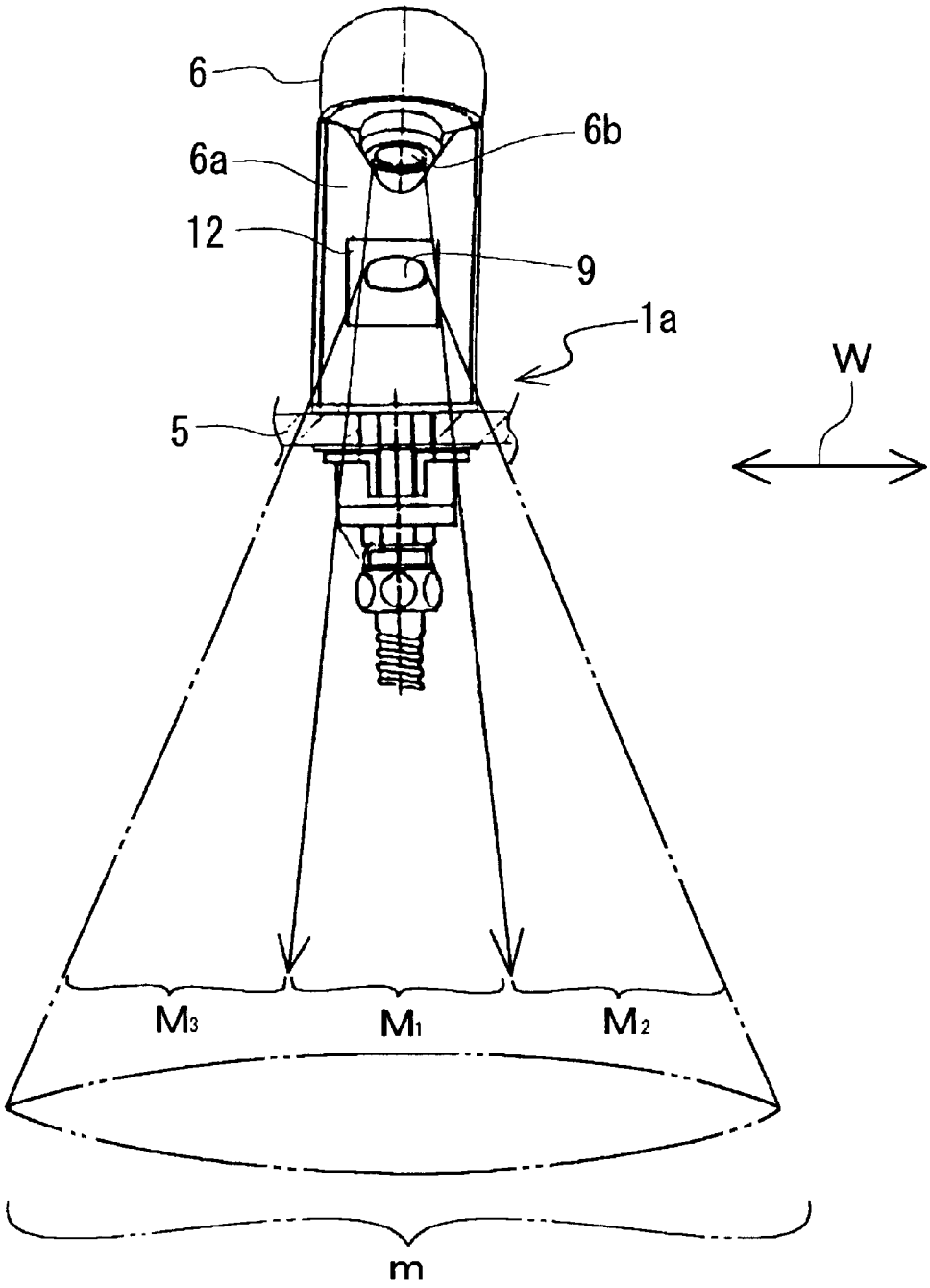
FIG. 4 is a structural explanatory diagram showing the width of viewing field region of artificial retina sensor in the lateral direction in the embodiment.

On the other hand, the artificial retina sensor 2 has a camera function, and is disposed on the front side 6*a* of the discharge pipe 6 so that the input image captured by the artificial retina sensor 2 through a sensing window 9 (described later) may be within a conical viewing field region (light receiving region) (m) as shown in FIG. 2, FIG. 3, and FIG. 4. FIG. 2, FIG. 3, and FIG. 4 show the viewing field region (m) of the artificial retina sensor 2, and more specifically FIG. 2 and FIG. 3 show the range along the height direction (T direction) from the bottom (g) of the bowl 4 of the basin 1*a,* while FIG. 4 shows the width in the lateral direction (W direction) of the basin 1*a*. The range along the T direction of the viewing field region (m) is from the bottom (g) of the bowl 4 to the position of height (h). Further, in FIG. 4, $M_1$ is water discharge region, and when the user projects hands into this region $M_1$ and brings closer to the discharge port 6*b,* water is discharged from the discharge port 6*b*. Meanwhile, $M_2$ and $M_3$ are non-discharge regions. In this embodiment, the artificial retina sensor 2 has 1024 (32×32) pixels (dots).

The artificial retina sensor 2 is mainly composed of, as shown in FIG. 2, a wide-angle lens 7 of a circular front view forming a nearly conical viewing field region (m), a photo detector element array 8 positioned immediately beneath the wide-angle lens 7, and a sensing window 9 of a circular front view positioned immediately above the wide-angle lens 7. The photo detector element array 8 has a square front view, and is formed on a circuit board 11 mounted on a base 10, thereby forming an LSI. In this embodiment, for example, 1024 photo detector elements corresponding to a 32×32 image plate are disposed on the circuit board 11. That is, in the embodiment, the 32×32 image plate is composed of the photo detector element array 8, circuit board 11, and base 10. Reference numeral 12 is a cover for surrounding the sensing window 9, and 13 is a ring-shaped waterproof packing.

That is, in order to extend the viewing field region of the artificial retina sensor 2 as much as possible, in this embodiment, the wide-angle lens 7 is provided above the photo detector element array 8. By this wide-angle lens 7, the viewing field region (m) is set so as to include not only the water discharge region $M_1$ but also non-discharge regions $M_2$, $M_3$.

FIG. 6 to FIG. 9 show input images captured by the artificial retina sensor 2.

Figure 6:
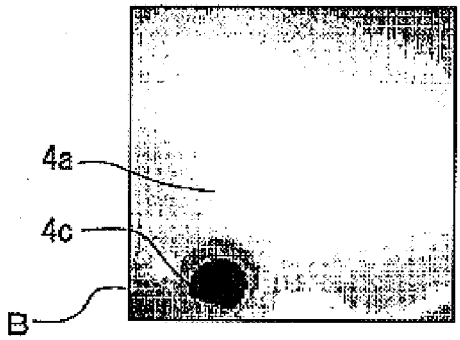
FIG. 6 is a diagram showing an input image of surface of a bowl in the embodiment.
Figure 7:
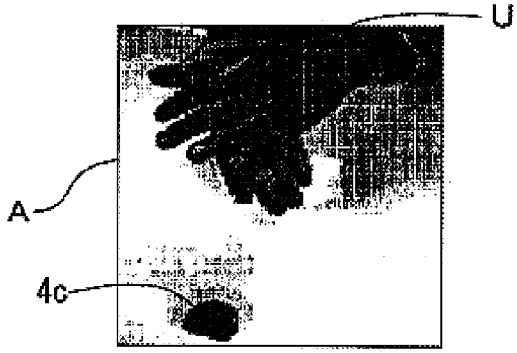
FIG. 7 is a diagram showing an input image when the user of the lavatory is washing hands in the embodiment.
Figure 8:
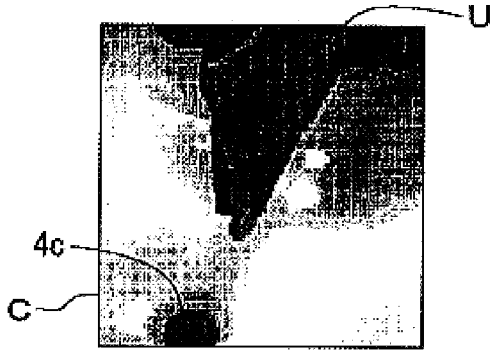
FIG. 8 is also a diagram showing an input image when the user of the lavatory is washing hands in the embodiment.
Figure 9:
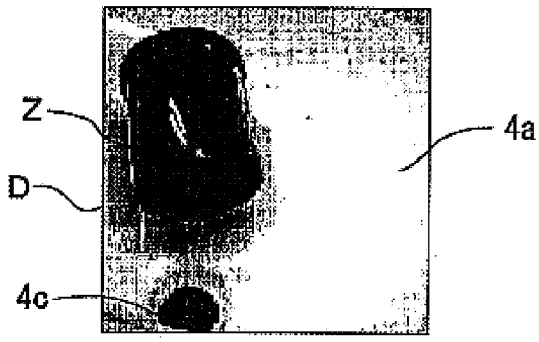
FIG. 9 is a diagram showing an input image of the bowl surface depicting a foreign matter other than the hands of the user in the embodiment.

FIG. 6 is an input image of the surface 4*a* of the bowl 4 made of, for example, white porcelain, and a drain hole 4*c* of the bowl 4 is depicted. FIG. 7 and FIG. 8 are input images of the user U of the hand washer 1 as object of detection in the process of washing hands. FIG. 9 is an input image of the surface 4*a* of the bowl 4 showing foreign matter Z other than the hands of the user U.

The control unit 3 is composed of, as shown in FIG. 1, a microcomputer 15, a memory 16 including two memory units 16*a,* 16*b,* a solenoid valve 17 responsible for water discharge and stopping action of the discharge pipe 6, a solenoid valve drive circuit 18 for driving and controlling the solenoid valve 17, a drive power source 21 of the control unit 3, an alarm display circuit 19 for displaying drop of supply voltage of the drive power source 21, and a low voltage circuit and voltage monitoring circuit 20.

The processing steps of input image captured by the artificial retina sensor 2 are shown. As the input image, an example of input image A in FIG. 7 is explained.

Figure 10:
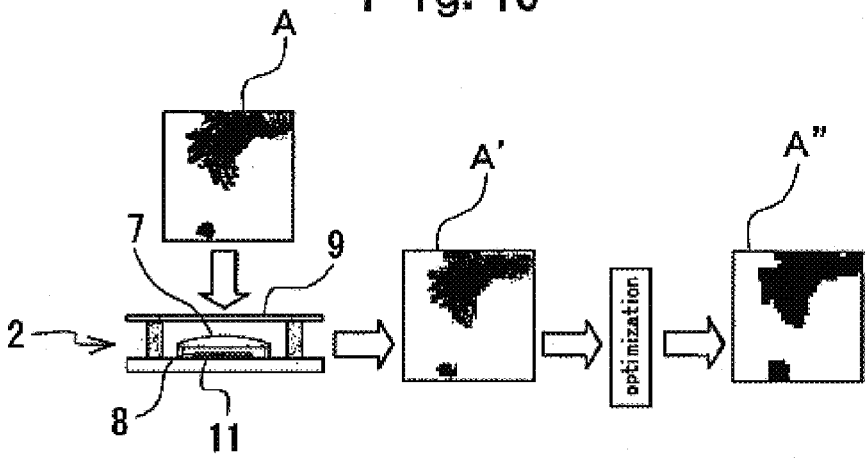
FIG. 10 is a structural explanatory diagram showing a processing step of input image in the embodiment.

In FIG. 10, (1) an input image A is issued from the artificial retina sensor 2 as an output image A', and is input to the microcomputer 15.

(2) In the microcomputer 15, the output image A' is optimized, and a recognition object image is acquired. As optimizing process, for example, when binary processing (black and white processing) is done, a recognition object image A" as shown in FIG. 10 is obtained (see also FIG. 12). As described below, the black display shows the presence of an object, and the white display indicates the absence of an object.

(3) This recognition object image (hereinafter called acquired image) A" is stored into the memory 16 from the microcomputer 15.

Figure 11:
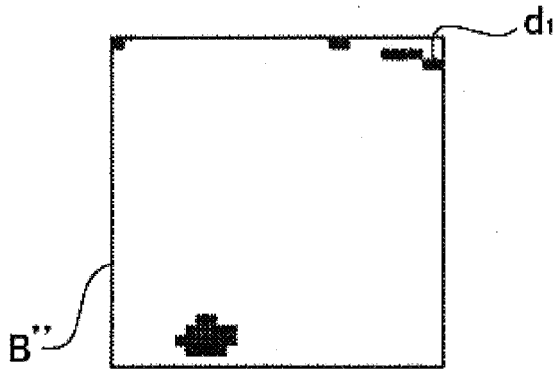
FIG. 11 is a diagram showing an acquired image in the embodiment.
Figure 12:
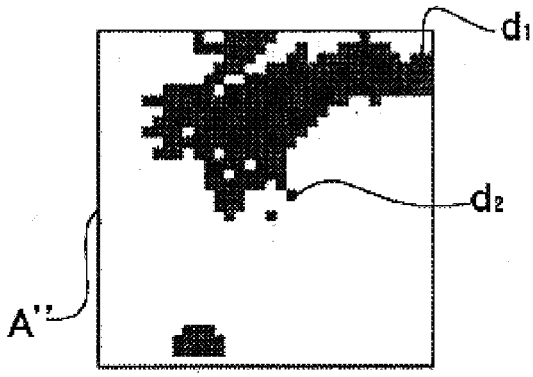
FIG. 12 is also a diagram showing an acquired image in the embodiment.

Similarly, by the microcomputer 15, the input image B in FIG. 6 is processed as acquired image B" (see FIG. 11). The input image C in FIG. 8 is processed as acquired image C". The input image D in FIG. 9 is processed as acquired image D".

Consequently, these acquired images A", B", C", D", and so forth are processed by the recognition algorithm in the memory 16. Meanwhile, the input images A, B, C, D, etc. are those obtained in the 32×32 image plates.

Relating to the acquired image B", acquired image A", and acquired image C" the processing procedure by the recognition algorithm is explained.

As mentioned above, FIG. 11 and FIG. 10 (FIG. 12) show acquired images B" and A" of the input image B and input image A, respectively.

Figure 5:
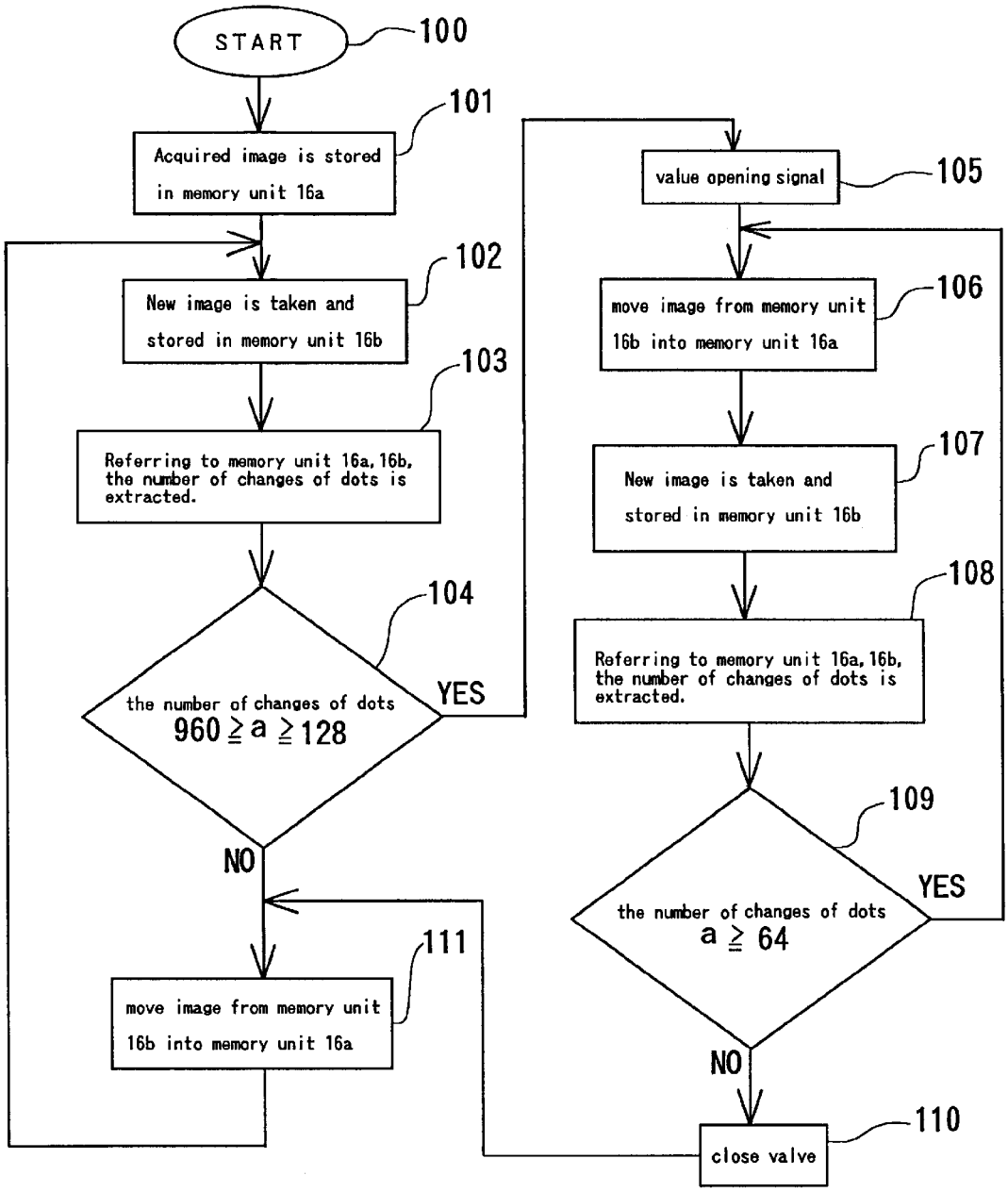
FIG. 5 is a flowchart showing automatic water feed process in the embodiment.

In FIG. 5, the user U goes to the hand washer 1 to wash hands (see step 100). First, at step 101, the acquired image B" while the user U is not washing hands is stored in the memory unit 16*a*.

Next, when the user U extends hands to the bowl 4 for washing, the acquired image A" is taken, and the acquired image A" is stored in the memory unit 16*b* (see step 102).

Figure 13:
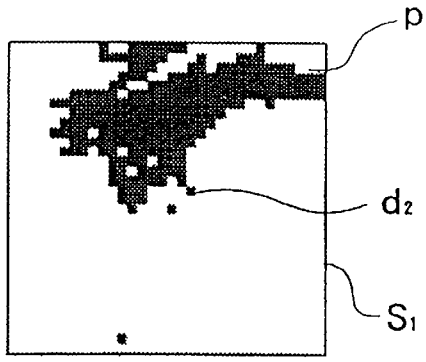
FIG. 13 is a diagram showing a change image extracting the number of dot changes in two continuous acquired images when transferring from non-use state to use state.

At step 103, referring to the memory units 16*a*, 16*b*, the number of changes (a) of dots for composing the image is extracted. That is, in the memory 16, the acquired image B" stored first in time and the acquired image A" stored later in time are compared, and only the position changed in the number of dots (difference) is extracted, so that a change image $S_1$ showing a dot change as shown in FIG. 13 is obtained.

For example, in FIG. 11, dot $d_1$ in black display shown in the first acquired image B" is also shown in the later acquired image A" (see FIG. 12), and hence in the change image $S_1$, position p of location of dot $d_1$ (see FIG. 13) is displayed in white, which tells no change is made.

By contrast, dot $d_2$ in black display shown in the acquired image A" (see FIG. 12) is not found at the corresponding position in the acquired image B" (see FIG. 11), and therefore in the change image $S_1$, dot $d_2$ remains in black display.

This invention is designed to judge if the number of dot changes (a) recognized in the change image $S_1$ is within a specified range or not (see step 104). For example, the upper limit of number of dot changes (a) is 960, and the lower limit is 128.

That is, at step 104, when the number of dot changes (a) is judged to be within this range, a valve opening signal for opening the solenoid valve 17 is sent from the microcomputer 15 to the solenoid valve drive circuit 18, so that water is discharged from the discharge pipe 6 (see step 105).

(1) In this case, the acquired image B" stored earlier than the acquired image A" is deleted, and the acquired image A" is moved from the memory unit 16*b* into the vacated memory unit 16*a* (see step 106).

In succession, the acquired image C" acquired later in time than the acquired image A" is stored into the vacated memory unit 16*b* (see step 107).

Further, same as at step 103, referring to the memory units 16*a*, 16*b*, the number of dot changes (a) for composing the image is extracted (see step 108). That is, in the memory 16, the acquired image A" stored first in time and the acquired image C" stored later in time are compared, and only the position changed in the number of dots is extracted, so that a change image $S_2$ showing a dot change as shown in FIG. 14 is obtained.

Figure 14:
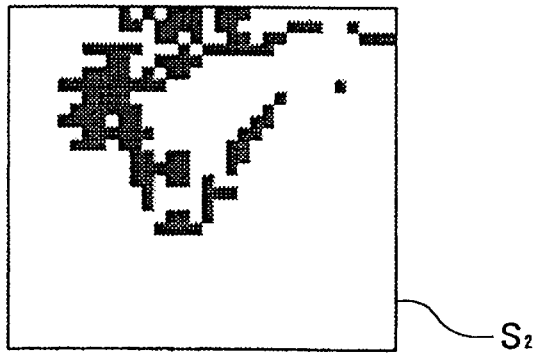
FIG. 14 is a diagram showing a change image extracting the number of dot changes in two continuous acquired images during use.
Figure 15:
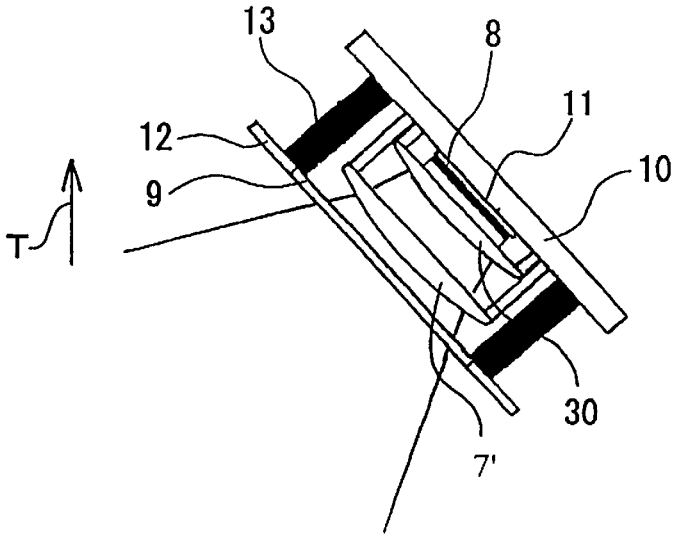
FIG. 15 is a structural explanatory diagram of artificial retina sensor in embodiment 2 of the invention.
Figure 16:
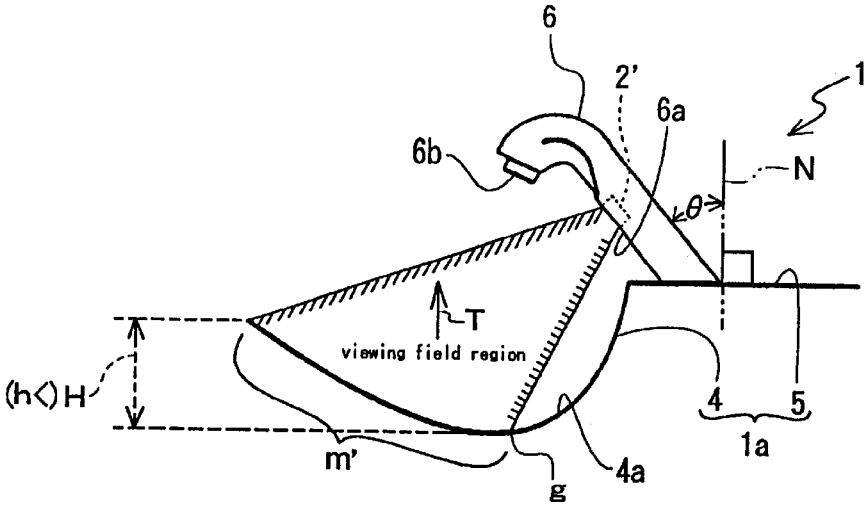
FIG. 16 is a structural explanatory diagram showing a range of viewing field region of artificial retina sensor in the height direction in embodiment 2.
Figure 17:
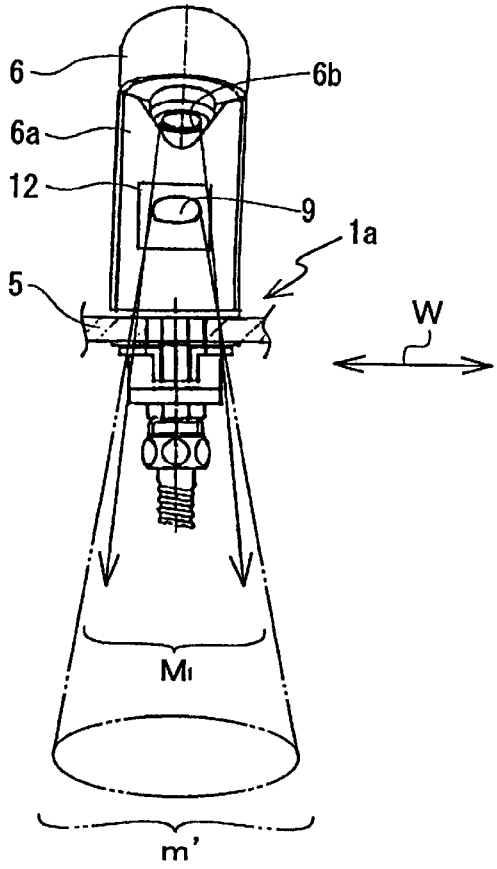
FIG. 17 is a structural explanatory diagram showing the width of viewing field region of artificial retina sensor in the lateral direction in embodiment 2.

That is, in FIG. 14, comparing two acquired images A" and C" as the object of detection during use of the hand washer, the change image $S_2$ extracting only dot changes in the acquired images A", C" is shown.

In this embodiment, when the number of dot changes (a) in the extracted change image $S_2$ is 64 or more, it is judged that the hand washer is being used (see step 109), and the acquired images C" and subsequent images are acquired continuously. When the number of dot changes (a) is less than 64, a valve close signal for closing the solenoid valve 17 is sent from the microcomputer 15 to the solenoid valve drive circuit 18 (see step 110). Then the process returns to step 105.

(2) At step 104, if the number of dot changes (a) is judged to be out of the specified range, the acquired image B" stored earlier than the acquired image A" is deleted, and the acquired image A" is moved from the memory unit 16*b* into the vacated memory unit 16*a* (see step 111). Then the process returns to step 102.

Thus, changes in the number of dots are operated in two consecutive acquired images B", A", and A", C", and the motion of the object of sensing is detected by the difference, so that the sensing method not affected by the color of the basin 1 can be presented.

At step 104, it is judged if water can be discharged or not in non-use state (closed state of solenoid valve 17). That is, when the solenoid valve 17 is closed, if the number of dot changes (a) is $a \geqq 128$, a valve open signal is sent to the solenoid valve 17, but the upper limit of the number of dot changes (a) is set at 960 because sensing control is effected visually. That is, in the environments of use, the surrounding brightness has a large influence, and in the case of a room, for example, considering a case of extinguishing of lighting, an upper limit is required in recognition value by the number of dot changes (a). As a result, malfunction due to lighting or extinguishing can be avoided.

The number of photo detector elements used in the invention is not limited to 1024.

FIG. 15 to FIG. 18 show embodiment 2 of the invention in which the viewing field region (m') is set so as to include only the water discharge region $M_1$ by using a condenser lens 30. In FIG. 15 to FIG. 18, same reference numerals as in FIG. 1 to FIG. 14 refer to same objects.

In FIG. 15 to FIG. 18, an artificial retina sensor 2' has a condenser lens 30 disposed between a narrow-angle lens 7' and a photo detector element array 8.

Figure 18:
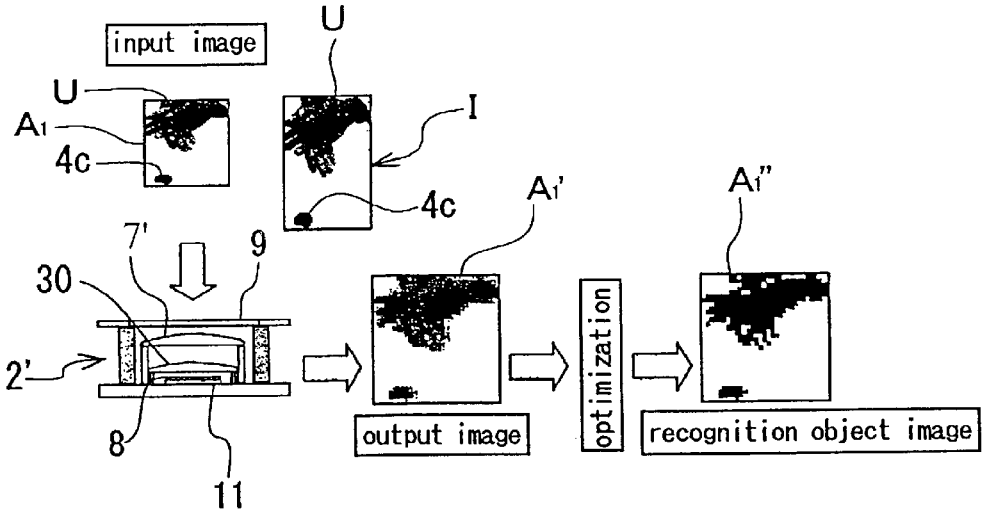
FIG. 18 is a structural explanatory diagram showing a processing step of input image in embodiment 2.

The condenser lens 30 has a function of narrowing the width in the W direction of the viewing field region (m) in embodiment 1 so as to include only the water discharge region $M_1$, and further setting the height in the T direction in viewing field region (m') higher than in the viewing field region (m) in embodiment 1. The range along the T direction of the viewing field region (m') is from the bottom (g) of the bowl 4 to the position of height H (>h). The width in the lateral direction (W direction) of the viewing field region (m') includes only the water discharge region $M_1$. As a result, the image I of the viewing field region (m') seen from the sensing window 9 is as shown in FIG. 18. That is, by disposing the condenser lens 30 between the narrow-angle lens 7' and photo detector element array 8, the viewing field region (m') can be heightened in the height direction (T direction), and the viewing field region (m') is set vertically long so as to include only the water discharge region $M_1$.

On the other hand, the narrow-angle lens 7' is set to narrow the viewing field region (m') of the artificial retina sensor 2' as much as possible. As a result of combination of the narrow-angle lens 7' and condenser lens 30, the input image $A_1$ captured by the artificial retina sensor 2' through the sensing window 9 is as shown in FIG. 18.

In FIG. 18, (1) the input image $A_1$ becomes an output image $A_1'$ from the artificial retina sensor 2', and is input to the microcomputer 15. (2) In the microcomputer 15, the output image $A_1'$ is optimized, and a recognition object image $A_1''$ is obtained.

In this embodiment, since the non-discharge regions $M_2$, $M_3$ are not included in the viewing field region m' of the artificial retina sensor 2', useless information from the non-discharge regions $M_2$, $M_3$ can be omitted. Accordingly, the recognition object image (acquired image) $A_1''$ obtained in the artificial retina sensor 2' is sharper, and the motion of hands of the user U in the water discharge region $M_1$ can be judged more accurately, so that malfunction can be prevented securely.

The invention is not limited to the hand washer, but may be applied to flush urinal and other lavatories.

The first to fourth aspects of the invention using one artificial retina sensor have been explained so far.

In fifth and sixth aspects of the invention, a plurality of artificial retina sensors are used as explained below.

FIG. 19 to FIG. 25 refer to embodiment 3 of the invention configured so as to monitor the user U of a flush urinal 31 from a position immediately above the flush urinal 31, by disposing a pair of artificial retina sensors $\mathbf{2}_{Right}$, $\mathbf{2}_{Left}$ at right and left positions of a water feed piping 32 of the flush urinal 31 so that the central axes $X_1$, $X_2$ of the viewing field regions (light receiving regions) m, m may be parallel to each other. In FIG. 19 to FIG. 25, same reference numerals as in FIG. 1 to FIG. 18 refer to same objects.

Figure 19:
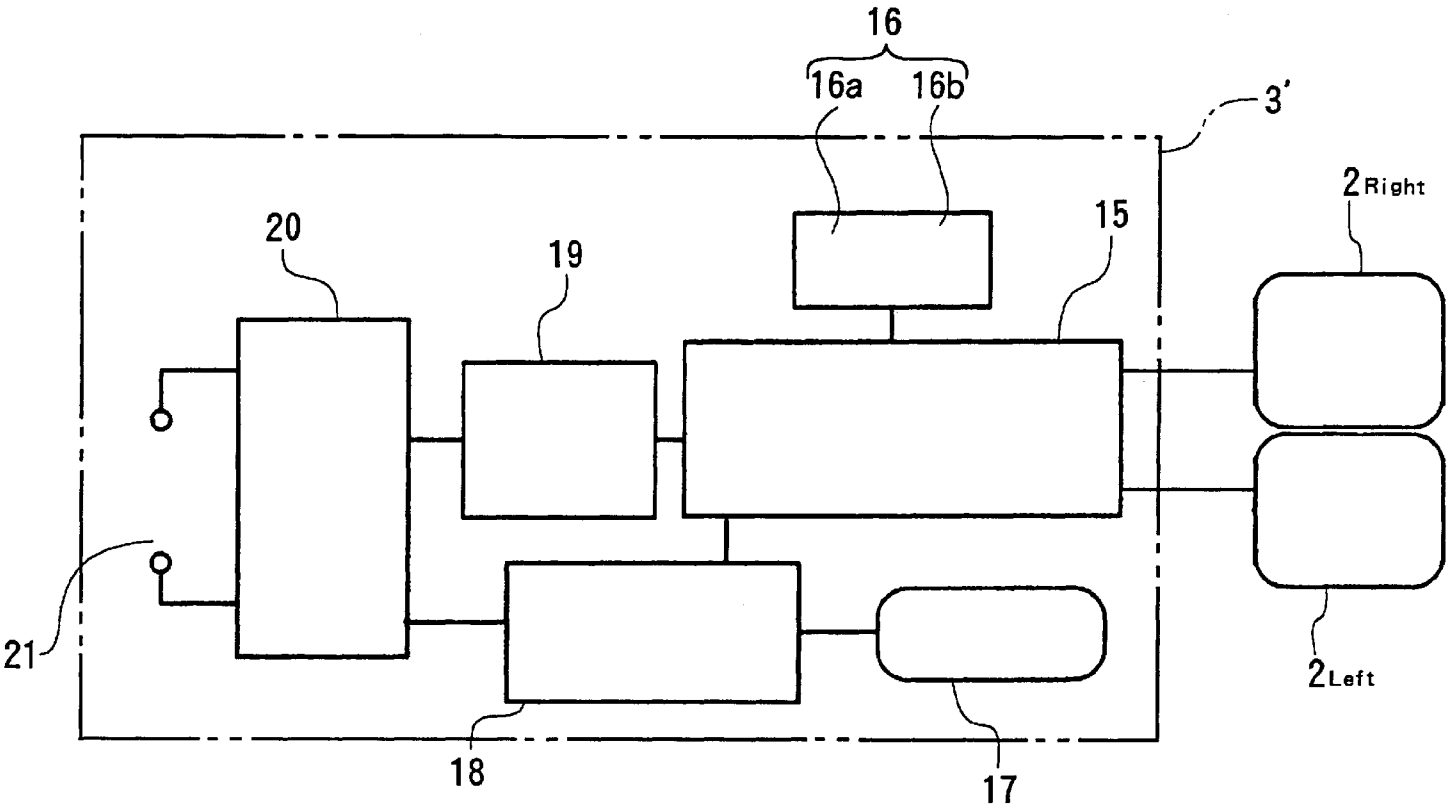
FIG. 19 is a general structural explanatory diagram showing embodiment 3 of the invention.
Figure 21:
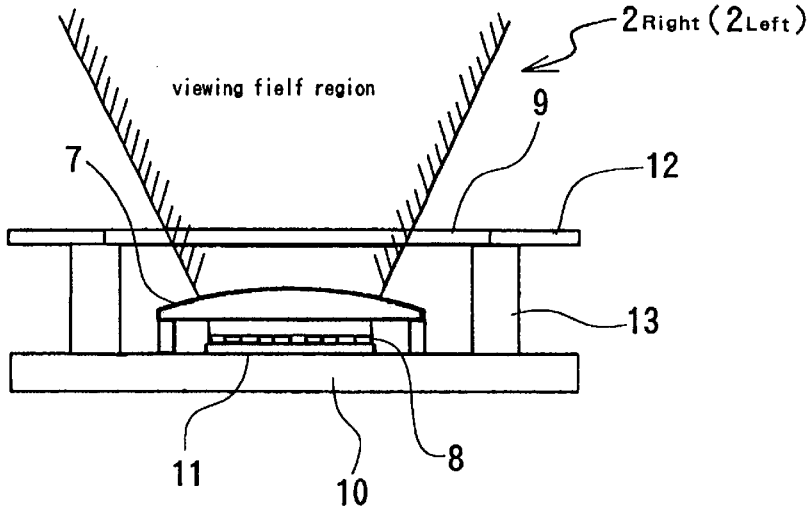
FIG. 21 is a structural explanatory diagram of artificial retina sensor in embodiment 3 of the invention.

In FIG. 19 and FIG. 21, the automatic water feed mechanism comprises the flush urinal 31, two artificial retina sensors $\mathbf{2}_{Right}$, $\mathbf{2}_{Left}$ having a camera function, and a control unit 3' for controlling the water feed operation of the flush urinal 31 on the basis of outputs from the artificial retina sensors $\mathbf{2}_{Right}$, $\mathbf{2}_{Left}$. The artificial retina sensor $\mathbf{2}_{Right}$ is positioned at the right side of the front of the flush urinal 31, and the artificial retina sensor $\mathbf{2}_{Left}$ is positioned at the left side of the front of the flush urinal 31. The two artificial retina sensors $\mathbf{2}_{Right}$, $\mathbf{2}_{Left}$ are provided because the user U of the flush urinal 31 as the object of sensing can be recognized securely with a perspective sense as compared with the case of one artificial retina sensor.

The flush urinal 31 is installed in a vertical state on a front side 34*a* of a wall 34. Reference numeral 32 is a water feed piping, which projects upward from the top of the flush urinal 31, and is bent to the wall side, and is connected to a piping 36 disposed at the rear side 34*b* of the wall 34. That is, the downstream end of the water feed piping 32 is connected to the flush urinal side, and the upstream end is connected to the piping 36.

The structure of the artificial retina sensors $\mathbf{2}_{Right}$, $\mathbf{2}_{Left}$ is as shown in FIG. 21, which is same as the structure of the artificial retina sensor 2 shown in FIG. 2.

Figure 23:
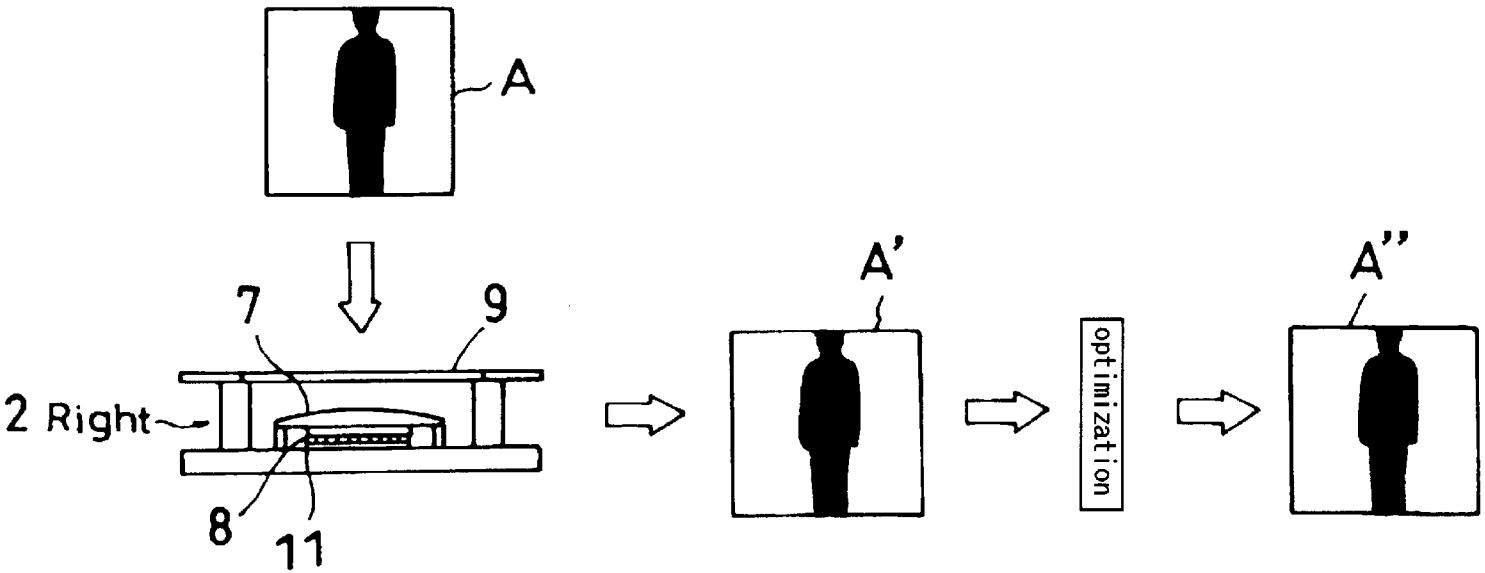
FIG. 23 is a structural explanatory diagram showing an example of processing step of input image in embodiment 3.

In FIG. 23, A is an image seen from the sensing window 9 of, for example, the artificial retina sensor $\mathbf{2}_{Right}$. That is, A is an input image captured by the artificial retina sensor $\mathbf{2}_{Right}$.

The processing steps of the image seen from the sensing window 9 of the artificial retina sensor $\mathbf{2}_{Right}$ are explained below while referring to FIG. 19 and FIG. 23.

In FIG. 19 and FIG. 23, (1) the input image A becomes an output image A' from the artificial retina sensor $\mathbf{2}_{Right}$, and is input to the microcomputer 15.

(2) In the microcomputer 15, the output image A' is optimized, and a recognition object image is acquired. As optimizing process, for example, when binary processing (black and white processing) is done, a recognition object image A" as shown in FIG. 23 is obtained. As described below, the black display shows the presence of an object (the user U), and the white display indicates the presence of the flush urinal 31.

(3) This recognition object image (hereinafter called acquired image) A" is stored into the memory 16 from the microcomputer 15.

Figure 24:
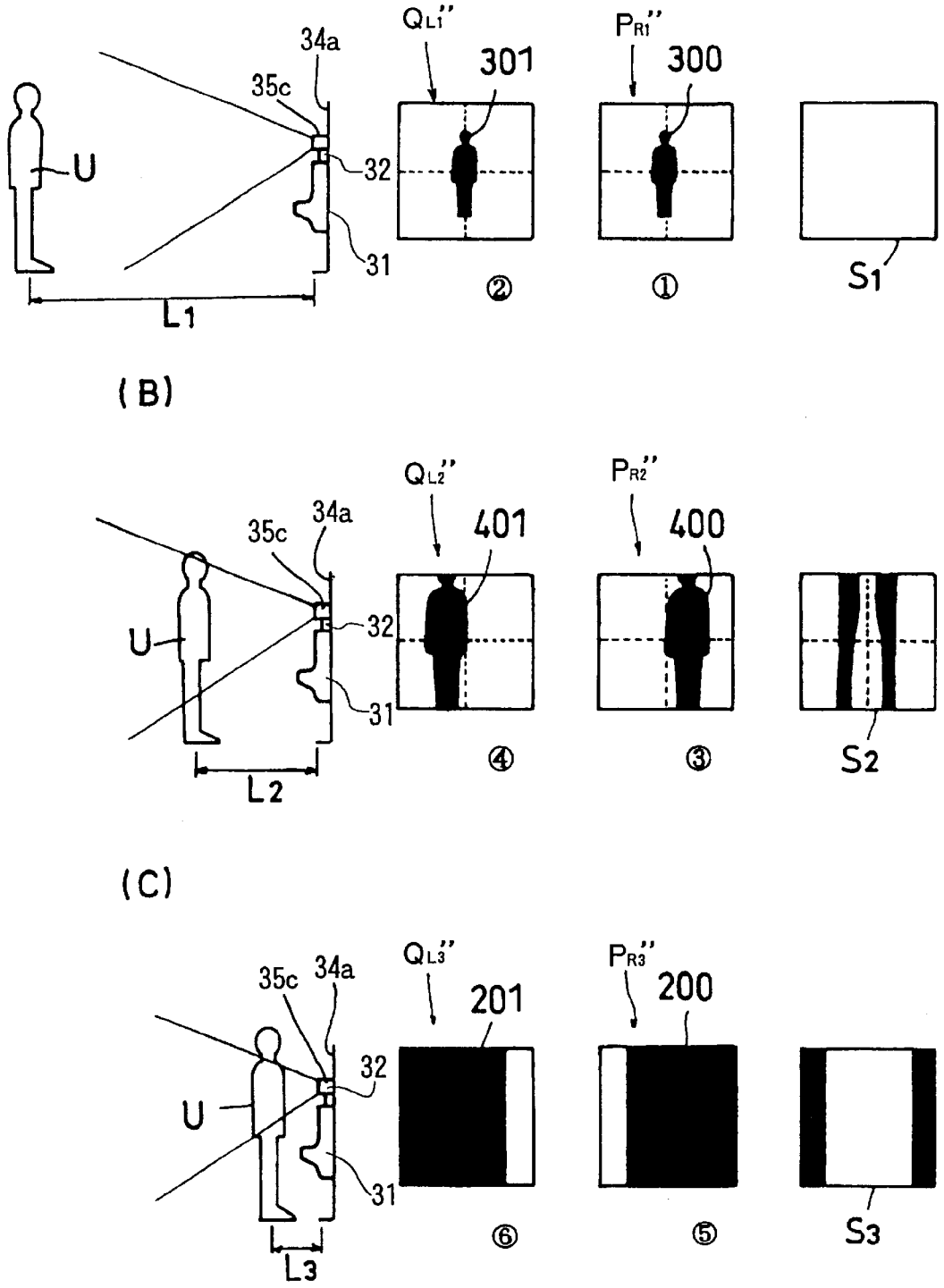
FIG. 24 is an operation explanatory diagram showing an example of automatic water feed operation in embodiment 3.

On the other hand, FIG. 24 is a diagram explaining the water feed operation of the flush urinal 31 when the user U approaches the flush urinal 31.

FIG. 24(A) shows an acquired image $P_{R1}''$ corresponding to the input image P (not shown) captured by the artificial retina sensor $\mathbf{2}_{Right}$ and an acquired image $Q_{L1}''$ corresponding to the input image Q (not shown) captured by the artificial retina sensor $\mathbf{2}_{Left}$, when the user U of the flush urinal 31 is at a remote position. Naturally, these acquired images $P_{R1}''$ and $Q_{L1}''$ correspond to the images seen at the same time from the sensing windows 9, 9. In FIG. 24(A), for example, the flush urinal 31 and the user U of the flush urinal 31 are apart by a distance corresponding to length $L_1$. As mentioned above, for example, the acquired image $P_{R1}''$ is an acquired image obtained as a result of optimizing process (for example, binary processing) of the output image P' as the input image P is input to the microcomputer 15 through the output image P' (not shown) from the artificial retina sensor $\mathbf{2}_{Right}$. Since the user U is away, the input image P and input image Q are nearly same and there is few mutual change.

FIG. 24(B) shows an acquired image $P_{R2}''$ corresponding to the input image P" (not shown) captured by the artificial retina sensor $\mathbf{2}_{Right}$ and an acquired image $Q_{L2}''$ corresponding to the input image Q" (not shown) captured by the artificial retina sensor $\mathbf{2}_{Left}$, when the user U approaches the flush urinal 31.

Naturally, these acquired images $P_{R2}''$, $P_{R1}''$ and acquired images $Q_{L2'', QL1}''$ are mutually consecutive images. That is, FIG. 24(B) shows the acquired images $P_{R2}''$, $Q_{L2}''$, for example, when the distance between the flush urinal 31 and the user U of the flush urinal 31 is shortened to a distance corresponding to length $L_2$ ($<L_1$). As mentioned above, for example, the acquired image $P_{R2}''$ is an acquired image obtained as a result of optimizing process (for example, binary processing) of the output image P'" as the input image P" is input to the microcomputer 15 through the output image P'" (not shown) from the artificial retina sensor $\mathbf{2}_{Right}$, but as compared with the case of FIG. 24(A), since the user U is closer to the flush urinal 31, the acquired image $P_{R2}''$ and acquired image $Q_{L2}''$ are mutually different.

FIG. 24(C) shows an acquired image PR3" and an acquired image QL3" when the user U approaches more closely to the flush urinal 31 as compared with the case in FIG. 24(B). Naturally, these acquired images $P_{R3}$", $P_{R2}$" and acquired images $Q_{L3}$", $Q_{L2}$" are mutually consecutive images. That is, FIG. 24(C) shows the acquired image $P_{R3}$" corresponding to the input image captured by the artificial retina sensor $\mathbf{2}_{Right}$ and acquired image $Q_{L3}$' corresponding to the input image captured by the artificial retina sensor $\mathbf{2}_{Left}$, when the distance between the flush urinal 31 and the user U of the flush urinal 31 is shortened further to a distance corresponding to, for example, length $L_3$ ($<L_2<L_1$). As mentioned above, for example, the acquired image $P_{R3}$" is an acquired image obtained as a result of optimizing process (for example, binary processing) of the output image as the input image seen from the sensing window 9 is input to the microcomputer 15 through the output image from the artificial retina sensor $\mathbf{2}_{Right}$. However, as compared with the case of FIG. 24(B), since the user U is further closer to the flush urinal 31, the image of the user U appears on the entire surface of the input image seen from the sensing window 9, and, as mentioned below, since artificial retina sensors $\mathbf{2}_{Right}$, $\mathbf{2}_{Left}$ are disposed at right and left symmetrical positions so that the central axes $X_1$, $X_2$ of the viewing field regions (light receiving regions) m, m may be parallel to each other, in the acquired image $P_{R3}$' and the acquired image $Q_{L3}$", the image portions 200, 201 corresponding to the image of the user U are nearly covering the entire area, the image portions 200, 201 are mutually positioned asymmetrically.

Figure 22:
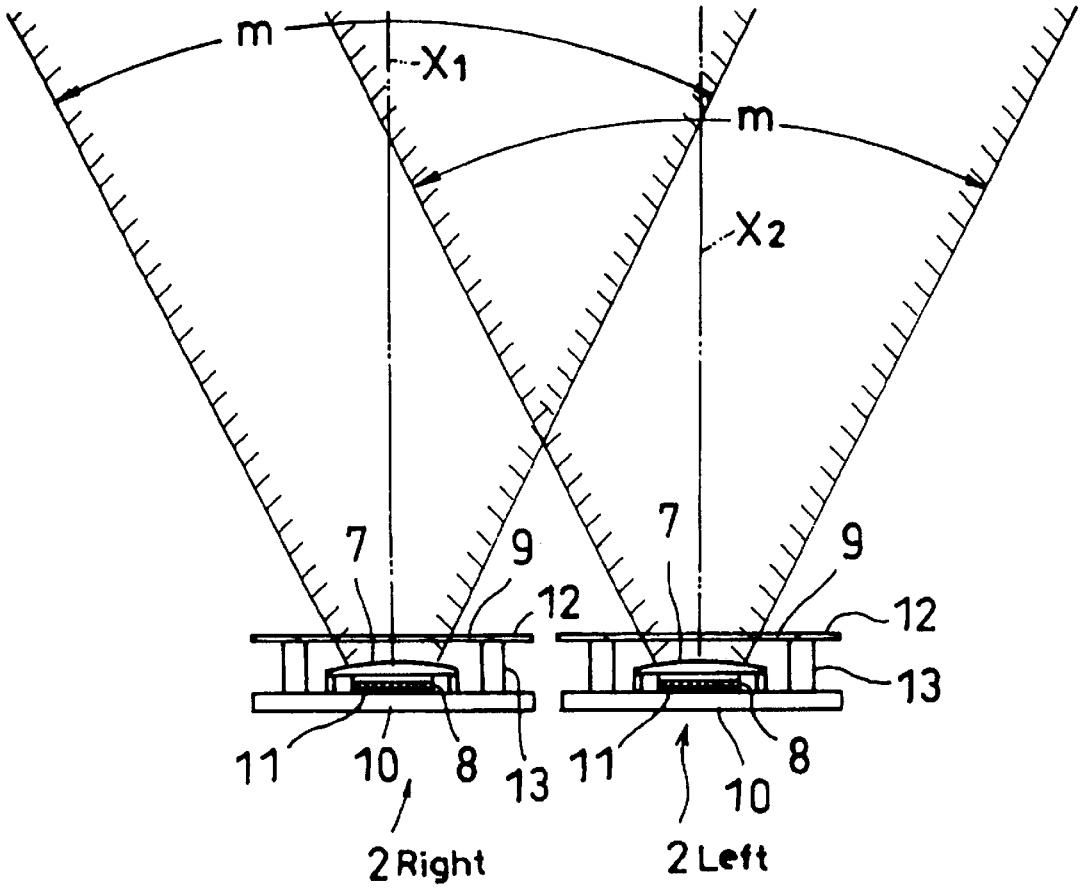
FIG. 22 is a structural explanatory diagram showing the viewing field region of artificial retina sensor in embodiment 3.

Further, the two artificial retina sensors $\mathbf{2}_{Right}$, $\mathbf{2}_{Left}$ are disposed at right and left symmetrical positions on both sides of the water feed piping 32 (see FIG. 22).

For example, a fixing plate (not shown) for fixing the artificial retina sensors $\mathbf{2}_{Right}$, $\mathbf{2}_{Left}$ is installed at the front side 34*a* of the wall 34, and the two artificial retina sensors $\mathbf{2}_{Right}$, $\mathbf{2}_{Left}$ are fitted to the fixing plate with the sensing windows 9, 9 facing the direction vertical to the front side 34*a* of the wall 34.

In this embodiment, as shown in FIG. 22, the artificial retina sensors $\mathbf{2}_{Right}$, $\mathbf{2}_{Left}$ are disposed at right and left symmetrical positions on both sides of the water feed piping 32 so that the central axes $X_1$, $X_2$ of the viewing field regions (light receiving regions) m, m may be parallel to each other.

Then a box-shaped cover 35*c* having openings 9*a*, 9*a* [see FIG. 20(C)] where the two sensing windows 9, 9 are positioned is fitted to the fixing plate, and the two artificial retina sensors $\mathbf{2}_{Right}$, $\mathbf{2}_{Left}$ are covered.

In this embodiment, the artificial retina sensors $\mathbf{2}_{Right}$, $\mathbf{2}_{Left}$ having 1024 (32×32) pixels (dots) are used, but other two artificial retina sensors having a different number of pixels (dots) may be also used in the present invention. The control unit 31 of the embodiment is same in configuration as the control unit 3 shown in FIG. 1.

Referring now to examples of the acquired image $P_{R1}$" (hereinafter called LSI① image), acquired image $QL_1$" (LSI② image), the acquired image $P_{R2}$" (LSI③ image), acquired image $Q_{L2}$" (LSI④ image), acquired image $P_{R3}$" (LSI⑤ image), and acquired image $Q_{L3}$' (LSI⑥ image), procedure of processing by recognition algorithm is explained.

Figure 25:
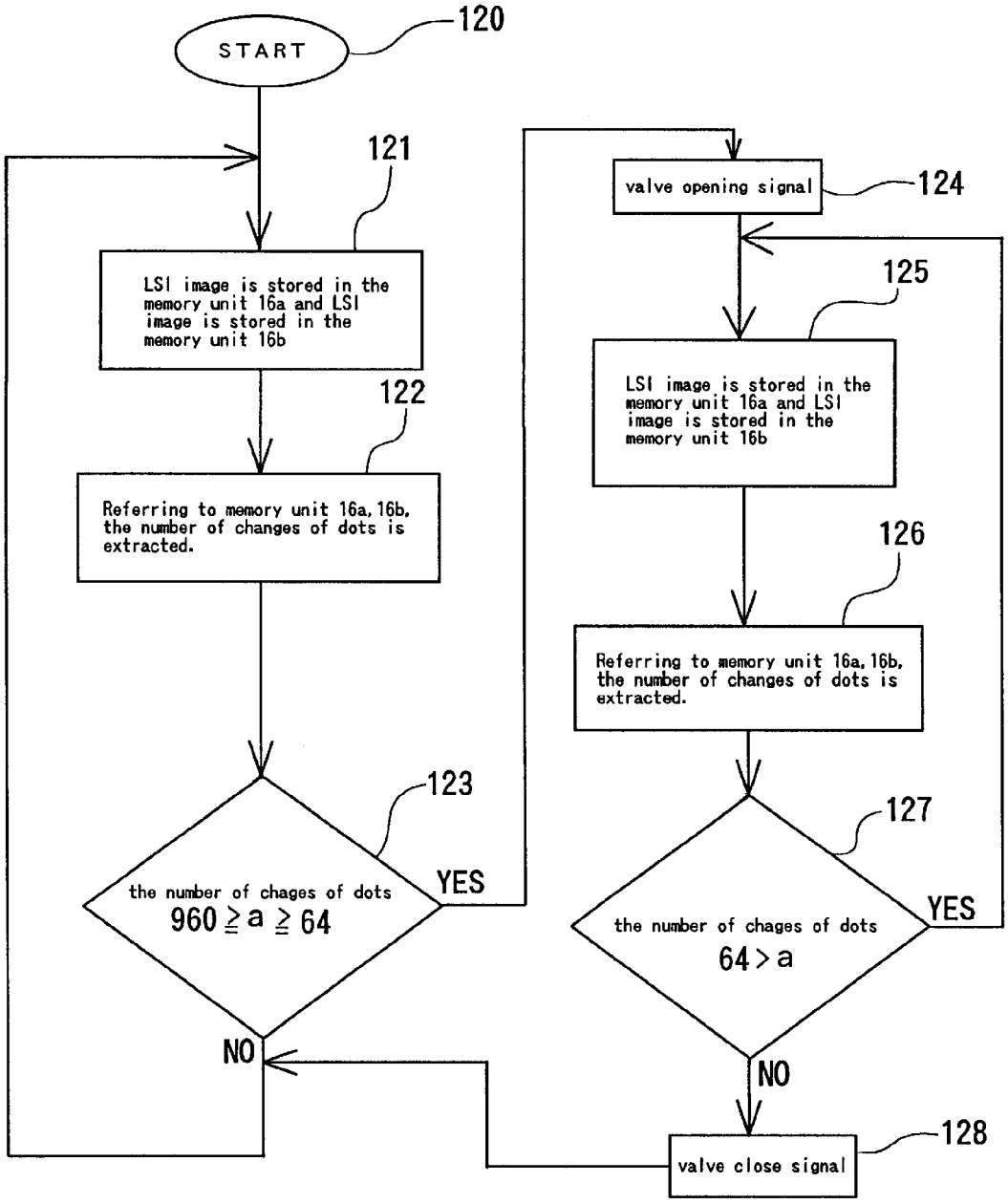
FIG. 25 is a flowchart showing an example of automatic water feed process in embodiment 3 of the invention.

In FIG. 24(A) and FIG. 25, the user U goes to the flush urinal 31 (see step 120). First, as shown at step 121, while the user U is away from the flush urinal 31 by a distance corresponding to length $L_1$, of the two LSI images, for example, LSI① image is stored in the memory unit 16*a* and LSI② image is stored in the memory unit 16*b*.

In FIG. 24(A), the image portion 300 (black portion) corresponding to the image of the user U in the LSI① image is supposed to be composed of M dots. Similarly, the image portion 301 (black portion) corresponding to the image of the user U in the LSI② image is supposed to be composed of N dots. At step 122, the memory units 16*a*, 16*b* are referred to, the change in the number of dots is calculated, and the number of dot changes (a) (=absolute value |M−N|) is extracted.

Herein, to calculate the number of dot changes, (1) Overlapping the LSI① image and LSI② image, if there is an overlapping portion of image portions 300, 301, it means to calculate so as to delete the overlapping portion and maintain the non-overlapping portions of image portions 300, 301. That is, it means to calculate the absolute value |M−N|, and (2) As shown, for example, in FIG. 27(A) below, if there is no overlapping portion of image portions 300*a*, 301*a* by overlapping the LSI① image and LSI② image, it means to calculate to maintain the both portions 300*a*, 301*a*. That is, it means to calculate the number of dot changes (a) (=number of dots G for composing image portion 300*a*+number of dots H for composing image portion 301*a*).

As a result of the calculation, the change image $S_1$ shown in FIG. 24(A) is obtained. As recognized in this change image $S_1$, the number of dot changes (a) presumed to be displayed in black is hardly observed.

This is because the user U is away from the flush urinal 31, the central axes $X_1$, $X_2$ of the viewing field regions (light receiving regions) m, m are parallel to each other, and the artificial retina sensors $\mathbf{2}_{Right}$, $\mathbf{2}_{Left}$ are disposed at right and left symmetrical positions, and therefore the image portions 300, 301 are composed of a nearly same number of dots (M being nearly equal to N), and are present at the same position.

The present invention is configured to judge if the number of dot changes (a) recognized in the change image $S_1$ is within a specified range or not (see step 123). For example, the upper limit of the number of dot changes (a) (=absolute value |M−N|) is 960, and the lower limit is set at 64.

That is, at step 123, when the absolute value |M−N| is judged to be in a range of 960≧number of dot changes (a) ≧64, a valve open signal for opening the solenoid valve 17 is sent from the microcomputer 15 to the solenoid valve drive circuit 18, and water is discharged from the water feed piping 32, but since the number of dot changes (a) (=M−N≈0) recognized in the change image $S_1$ is smaller than or equal to the lower limit, and the process returns to step 121, and newly acquired images shown in FIG. 24(B), that is, LSI③ image and LSI④ image are stored, for example, in the memory unit 16*a* and memory unit 16*b*, respectively. In this case, the already stored images LSI① image and LSI② image are deleted.

Successively, at step 122, the memory units 16*a*, 16*b* are referred to, and the number of changes of the number of dots M' for composing the image portion 400 (black portion) corresponding to the image of the user U in the LSI③ image and the number of dots N' for composing the image portion 401 (black portion) corresponding to the image of the user U in the LSI④ image are calculated, and the number of dot changes (a) (=absolute value |M'−N'|) is extracted. In this case, too, overlapping the LSI③ image and LSI④ image, the overlapping portion is deleted, and a change image $S_2$ as shown in FIG. 24(B) is obtained. In this case, too, the number of dot changes (a) of the change image $S_2$ judged at step 123 is smaller than or equal to the lower limit, and the process returns to step 121 again.

The LSI③ image and LSI④ image stored in the memory unit 16*a* and memory unit 16*b* are deleted, and newly acquired images shown in FIG. 24(C), that is, LSI⑤ image and LSI⑥ image are stored, for example, in the memory unit 16*a* and memory unit 16*b*, respectively.

Successively, at step 122, the memory units 16*a*, 16*b* are referred to, and the number of changes of the number of dots M" for composing the image portion 200 (black portion) corresponding to the image of the user U in the LSI⑤ image and the number of dots N" for composing the image portion 201 (black portion) corresponding to the image of the user U in the LSI⑥ image are calculated, and the number of dot changes (a) (=absolute value |N"−N"|) is extracted. In this case, too, overlapping the LSI⑤ image and LSI⑥ image, the overlapping portion is deleted, and a change image $S_3$ as shown in FIG. 24(C) is obtained. In this case, at step 123, the absolute value |M"−N"| is judged to be within a range of 960≧number of dot changes (a) ≧64.

Accordingly, at step 124, a valve open signal for opening the solenoid valve 17 is sent from the microcomputer 15 to the solenoid valve drive circuit 18, and water is discharged from the water feed piping 32.

During discharge of water, newly acquired novel images (consecutive image) not shown are stored in the memory unit 16*a* and memory unit 16*b* from which the LSI⑤ image and LSI⑥ image are deleted (see step 125). The novel images are respectively LSI⑦ image and LSI⑧ image, and the number of dot changes (a) is judged similarly.

That is, in the water discharge state, at step 126, the memory units 16*a*, 16*b* are referred to, and the number of changes of the number of dots M'" for composing the image portion corresponding to the image of the user U in the LSI ⑦ image (not shown) and the number of dots N'" for composing the image portion corresponding to the image of the user U in the LSI⑧ image (not shown) are calculated, and the number of dot changes (a) (=absolute value |M'"−N'"|) is extracted. In this case, if the absolute value |M'"−N'"| exceeds, for example, 64, it is judged that the user U leaves the flush urinal 31 (see step 127), and the microcomputer 15 sends a valve close signal to the solenoid valve 17 (see step 128).

On the other hand, if the absolute value |M'"−N'"| is, for example, less than 64, it is judged that the user U still remains at the flush urinal 31 (see step 127), and the valve open signal continues to be transmitted, and the process returns to step 125.

Figure 20:
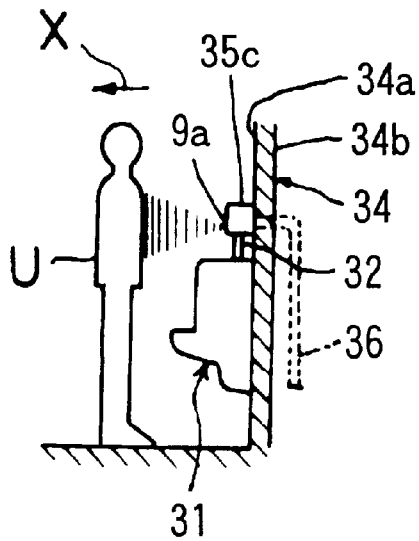
FIG. 20 is a diagram explaining an example of automatic water feed operation in embodiment 3.
Figure 20:
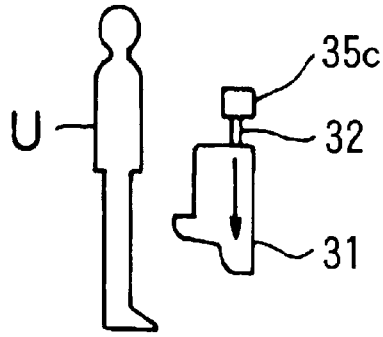
Figure 20:
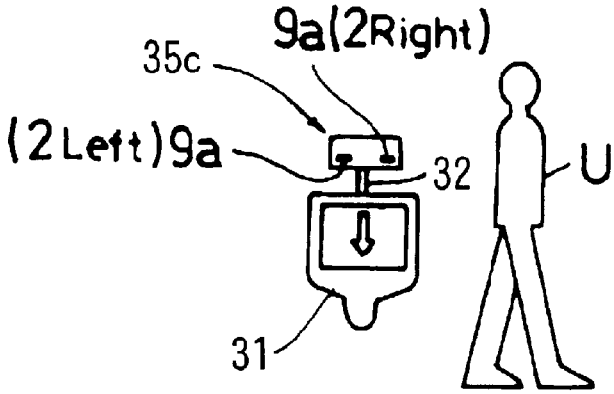

FIG. 20 shows an example of water feed operation. When the user U approaches the flush urinal 31 within 55 cm, a green lamp lights for 1 second [see FIG. 20(A)], and in about another 1 second, the flush urinal 31 is pre-washed for 2 seconds [see FIG. 20(B)]. After use, when the user U leaves the flush urinal 31, the flush urinal 31 is washed for 6 seconds [see FIG. 20(C)]. Moreover, to prevent drying of discharge pipe of the flush urinal 31 if the flush urinal 31 is not used for a long period, it is automatically flushed in every 24 hours.

Figure 26:
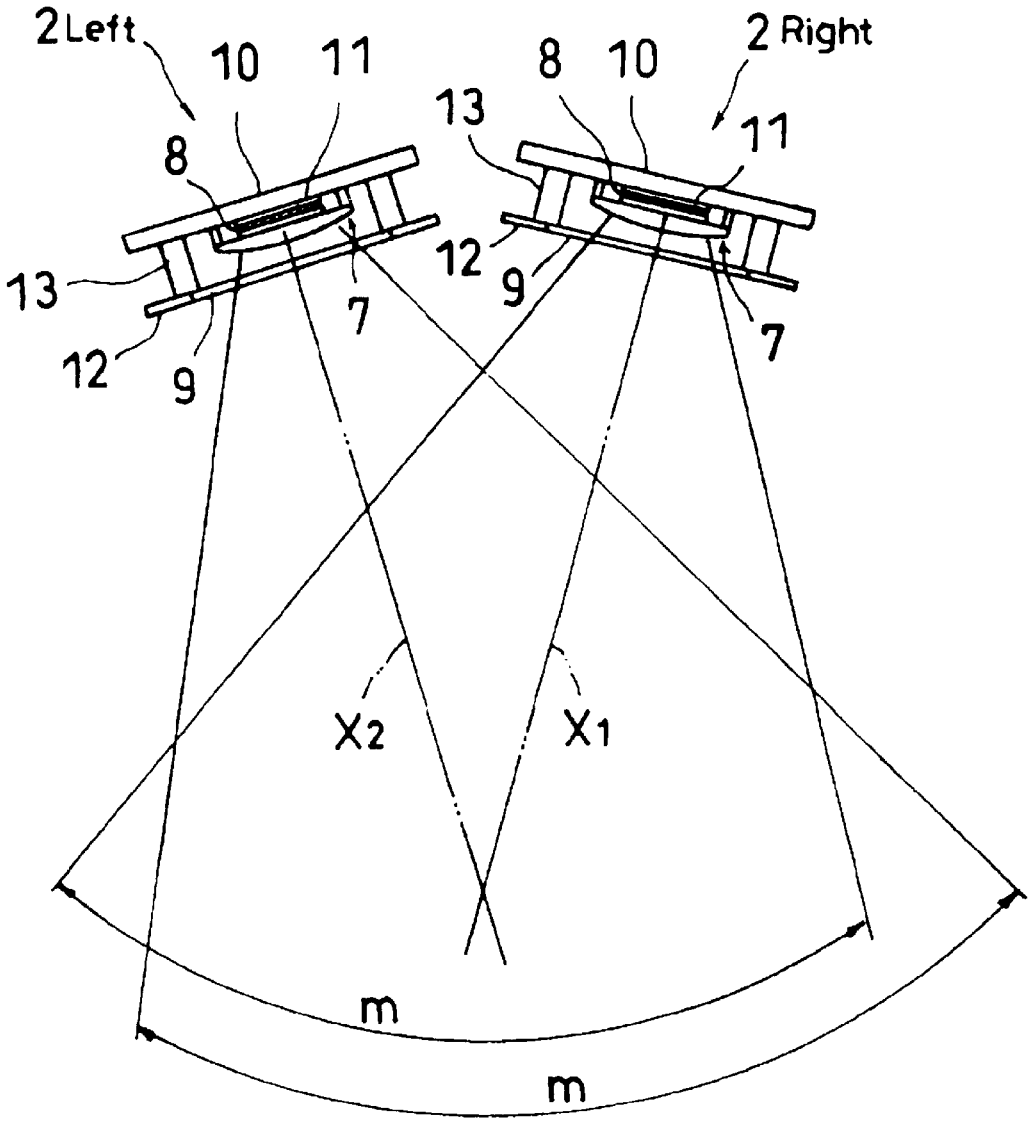
FIG. 26 is a structural explanatory diagram showing the viewing field region of artificial retina sensor in embodiment 4 of the invention.
Figure 27:
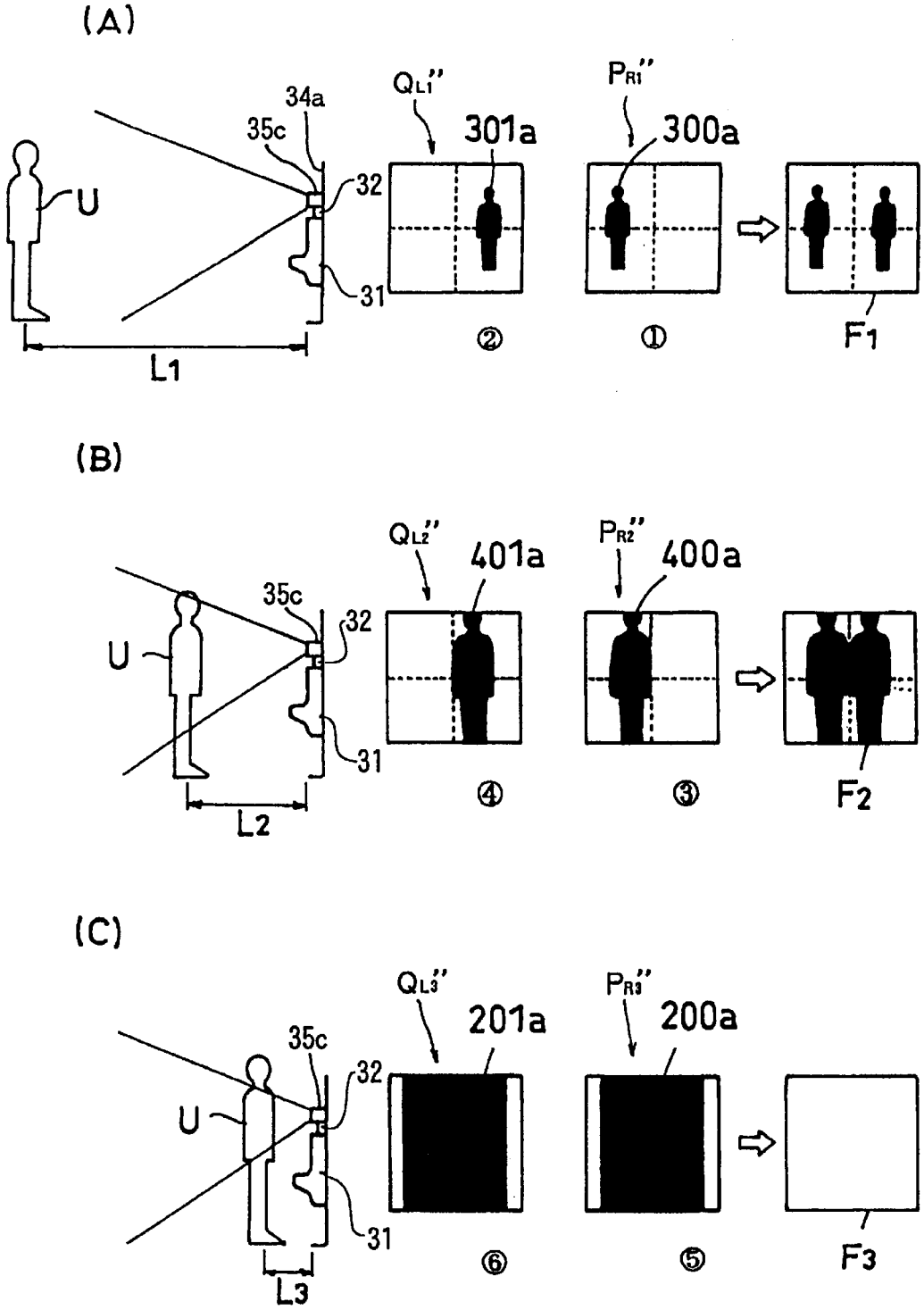
FIG. 27 is an operation explanatory diagram showing an example of automatic water feed operation in embodiment 4.
Figure 28:
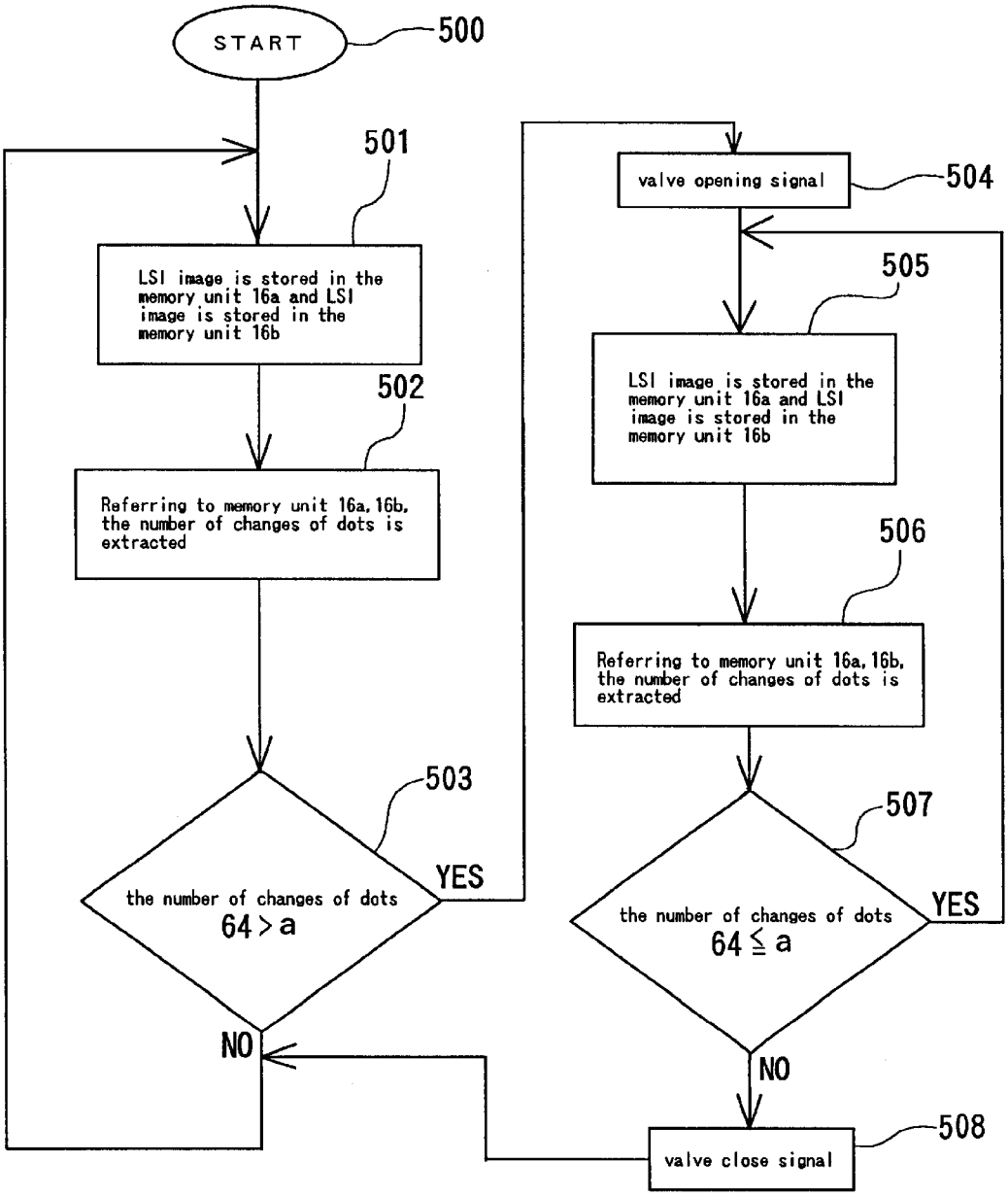
FIG. 28 is a flowchart showing an example of automatic water feed process in embodiment 4 of the invention.
Figure 29:
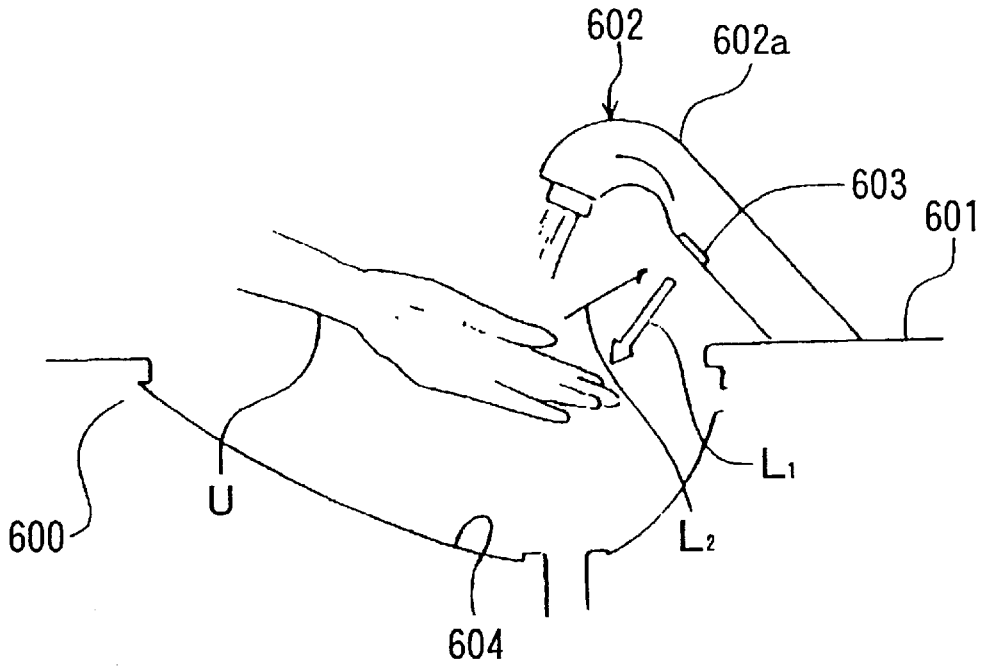
Fig. 29 PRIOR ART
FIG. 29 is a diagram showing a water feed operation in a prior art.

FIG. 26 to FIG. 28 refer to embodiment 4 of the present invention configured so as to monitor the user U of a flush urinal 31 from a position immediately above the flush urinal 31, by disposing a pair of artificial retina sensors $\mathbf{2}_{Right}$, $\mathbf{2}_{Left}$ at right and left positions of a water feed piping 32 of the flush urinal 31 so that the central axes $X_1$, $X_2$ of the viewing field regions (light receiving regions) m, m may intersect each other. In FIG. 26 to FIG. 28, same reference numerals as in FIG. 1 to FIG. 25 refer to same or equivalent objects.

The procedure of process by recognition algorithm is explained below.

In FIG. 27(A) and FIG. 28, the user U goes to the flush urinal 31 (see step 500). First, as shown at step 501, while the user U is away from the flush urinal 31 by a distance corresponding to length $L_1$, of the two LSI images, for example, LSI① image is stored in the memory unit 16*a* and LSI② image is stored in the memory unit 16*b*.

In FIG. 27(A), the image portion 300*a* (black portion) corresponding to the image of the user U in the LSI① image is supposed to be composed of G dots. Similarly, the image portion 301*a* (black portion) corresponding to the image of the user U in the LSI② image is supposed to be composed of H dots. At step 502, the memory units 16*a*, 16*b* are referred to, and the change in the number of dots (a) is extracted.

In this case, different from above-mentioned embodiment 3, in embodiment 4, since the artificial retina sensors $\mathbf{2}_{Right}$, $\mathbf{2}_{Left}$ are disposed at right and left positions of the water feed piping 32 of the flush urinal 31 so that the central axes $X_1$, $X_2$ of the viewing field regions (light receiving regions) m, m may intersect each other, the image portion 300*a* and image portion 301*b* are mutually composed of nearly same number pixels (G≈H), but are not located at the same position as in above-mentioned embodiment 3 as shown in FIG. 24(A), but are present at mutually exact opposite positions as shown in FIG. 27(A). That is, the change image $F_1$ obtained as a result of calculation of the number of dot changes is exactly same as the remaining of the image portion 300*a* and image portion 301*a*.

Next, at step 503, when the number of dot changes (a) recognized in the change image $F_1$ is judged to be less than 64, a valve open signal for opening the solenoid valve 17 is transmitted to the solenoid valve drive circuit 18 from the microcomputer 15, and water is discharged from the water feed pipe 32, but since the number of dot changes (a) recognized in the change image $F_1$ is more than or equal to 64, going back to step 501, newly acquired novel images shown in FIG. 27(B), that is, LSI③ image and LSI④ image are stored, for example, in the memory unit 16*a* and memory unit 16*b* respectively. In this case, the previously stored LSI① image and LSI② image are deleted.

Successively, at step 502, the memory units 16*a*, 16*b* are referred to, and the number of changes (a) of the number of dots G' for composing the image portion 400 (black portion) corresponding to the image of the user U in the LSI③ image and the number of dots H' for composing the image portion 401 (black portion) corresponding to the image of the user U in the LSI④ image are extracted. In this case, in FIG. 27(B) same as in FIG. 27(A), although the image portion 400*a* and image portion 401*a* are composed of a nearly same number of dots (G'≈H'), as shown in FIG. 24(B), the image portion 400 and image portion 401 are not partly overlapped, but the image portion 400*a* and image portion 401*a* are separate from each other, and the change image $F_2$ obtained as a result of calculation of the number of dot changes (a) is same as the remaining of the image portion 400*a* and image portion 401*a*. In this case, too, the number of dot changes (a) of the change image $F_2$ is more than or equal to 64, and the process returns to step 501 again.

After the LSI③ image and LSI④ image stored in the memory unit 16*a* and memory unit 16*b*, respectively, are deleted, newly acquired novel images shown in FIG. 27(C), that is, LSI⑤ image and LSI⑥ image are stored, for example, in the memory unit 16*a* and memory unit 16*b*, respectively.

Again, at step 502, the memory units 16*a*, 16*b* are referred to, and the number of changes (a) is extracted from the number of dots G" for composing the image portion 200*a* (black portion) corresponding to the image of the user U in the LSI⑤ image and the number of dots H" for composing the image portion 201*a* (black portion) corresponding to the image of the user U in the LSI⑥ image.

In this case, since the user U is further approaching the flush urinal 31, the image of the user U is shown in the entire area of the image seen from the sensing window 9, and the image portions 200*a,* 201*a* cover almost the entire area, and the image portions 200*a,* 201*a* are located nearly at same position. Hence, by overlapping LSI⑤ image and LSI⑥ image, the image portions 200*a,* 201*a* are overlapped almost completely. Hence, as recognized in the change image $F_3$ obtained as a result of calculation, the number of dot changes (a) presumed to be shown in black is hardly recognized.

Herein, the number of dot changes (a) recognized in the change image $F_1$ at step 503 is judged to be less than 64, and a valve open signal for opening the solenoid valve 17 (see step 504) is sent from the microcomputer 15 to the solenoid valve drive circuit 18, so that water is discharged from the water feed pipe 32.

During discharge of water, newly acquired novel images (consecutive images) not shown are stored in the memory unit 16*a* and memory 16*b,* respectively, from which the LSI⑤ image and LSI⑥ image have been deleted (see step 505). The novel images are LSI⑦ image and LSI⑧ image, and the number of dot changes (a) is similarly judged.

That is, in the water discharge state, at step 506, the memory units 16*a,* 16*b* are referred to, and the number of changes (a) is extracted. In this case, if the number of dot changes (a) is less than 64, it is judged that the user U is away from the flush urinal (see step 507), and the microcomputer 15 sends a valve close signal to the solenoid valve 17 (see step 508).

If the number of dot changes (a) is over 64, on the other hand, it is judged that the user U is not away from the flush urinal 31 (see step 507), and the transmission of valve open signal continues, and the process returns to step 505.

In the present invention, the number of photo detector elements is, natually, not limited to 1024.

Also, the present invention is not limited to the flush urinal, but may be applied in the hand washer and other lavatories.

What is claimed is:

1. A system for providing automatic control of water to a lavatory appliance upon sensing a user, comprising:

a lavatory appliance for delivering water to a user;

a control valve for controlling the flow of water through the lavatory appliance;

a sensor for acquiring two dimensional images of the region of discharge of the lavatory appliance, the sensor including a two dimensional array of pixels, the two dimensional images being composed of the output of the pixels;

an optimizing unit for receiving the two dimensional images from the sensor and generating acquired images, the acquired images being composed of the output of the pixels, the output of the pixels being optimized to one of two values based on a binary processing;

a first memory unit for storing a first acquired image from the optimizing unit;

a second memory unit for storing a second acquired image from the optimizing unit, the second acquired image being acquired after the first acquired image is acquired; and a comparison unit for comparing the first acquired image in the first memory unit with the second acquired image in the second memory unit to determine a number of pixel value changes for corresponding pixels of the first and second acquired images indicating movement of the user, whereby the control valve is activated when the number of pixel value changes is within a predetermined range.

2. The system of claim 1, wherein the predetermined range of pixel value changes is defined to include sensor output changes caused by the movement of one or more human hands within the discharge region of the lavatory appliance, and wherein the predetermined range of pixel value changes is defined to exclude sensor output changes due to a rapid change in brightness in the environment of use of the lavatory appliance.

3. The system of claim 1, wherein the predetermined range of pixel value changes is between about 12% to about 94% of the total number of pixels.

4. The system of claim 1, wherein the total number of pixels in each sensor is 1024, and the predetermined range of pixel value changes is between 128 and 960.

5. A method for providing automatic control of water to a lavatory appliance upon sensing a user, the lavatory appliance including a control valve for controlling the flow of water through the lavatory appliance, the method comprising the steps of:

acquiring a first image from a sensor in the region of discharge of a lavatory appliance, the first image being composed of the output of pixels;

processing the first acquired image to determine a first acquired image characteristic, the first acquired image characteristic being composed of the output of the pixels, the output of the pixels being assigned to one of two pixel values based on a binary processing;

storing the first acquired image characteristic in a first memory unit;

acquiring a second image from the sensor in the region of discharge of the lavatory appliance, the second image being composed of the output of pixels, the second image being acquired after the first image is acquired;

processing the second acquired image to determine a second acquired image characteristic, the second acquired image characteristic being composed of the output of the pixels, the output of the pixels being assigned to one of two pixel values based on a binary processing;

storing the second acquired image characteristic in a second memory unit;

comparing the first acquired image characteristic in the first memory unit to the second acquired image characteristic in the second memory unit to determine the number of pixel value changes for corresponding pixels of the first and second acquired images indicating movement of the user; and activating a control valve controlling the flow of water when the number of pixel value changes is within a predetermined range.

6. The method of claim 5, wherein the predetermined range of pixel value changes is defined to include sensor output changes caused by the movement of one or more human hands within the discharge region of the lavatory appliance, and wherein the predetermined range of pixel value changes is defined to exclude sensor output changes due to a rapid change in brightness in the environment of use of the lavatory appliance.

7. The method of claim 5, wherein the predetermined range of pixel value changes is between about 12% to about 94% of the total number of pixels.

8. The method of claim 5, wherein the total number of pixels in each sensor is 1024, and the predetermined range of pixel changes is between 128 and 960.

* * * * *